US012582877B2

(12) United States Patent
Haut

(10) Patent No.: US 12,582,877 B2
(45) Date of Patent: Mar. 24, 2026

(54) STRUCTURALLY REINFORCED PICKLEBALL

(71) Applicant: Adam Haut, Holly Springs, NC (US)

(72) Inventor: Adam Haut, Holly Springs, NC (US)

( * ) Notice: Subject to any disclaimer, the term of this patent is extended or adjusted under 35 U.S.C. 154(b) by 0 days.

(21) Appl. No.: 18/409,745

(22) Filed: Jan. 10, 2024

(65) Prior Publication Data

US 2025/0222309 A1 Jul. 10, 2025

(51) Int. Cl.
*A63B 37/00* (2006.01)
*A63B 102/08* (2015.01)

(52) U.S. Cl.
CPC ..... *A63B 37/0098* (2013.01); *A63B 2102/08* (2015.10)

(58) Field of Classification Search
CPC ..... A63B 37/0098; A63B 2102/08; A63B 43/002; A63B 2043/001
See application file for complete search history.

(56) References Cited

U.S. PATENT DOCUMENTS

D497,191 S * 10/2004 Shore ..... D21/709
9,592,426 B1 * 3/2017 DiPietro ..... A63B 37/0056
11,491,374 B1 * 11/2022 Newcomb ..... A63B 43/06
2013/0296085 A1 * 11/2013 Parenti ..... A63B 39/00 473/611
2014/0274465 A1 * 9/2014 Francis ..... A63B 39/00 473/613
2017/0354850 A1 * 12/2017 Chen ..... A63B 43/002
2024/0367009 A1 * 11/2024 Moonen ..... B29C 64/124
2025/0041675 A1 * 2/2025 Cruz ..... A63B 37/0098
2025/0195959 A1 * 6/2025 Franceschelli ..... A63B 37/14

FOREIGN PATENT DOCUMENTS

DE 102020125777 A1 * 4/2022 ..... A63B 39/00
EP 4467208 A2 * 11/2024 ..... A63B 37/14
WO WO-2012126442 A1 * 9/2012 ..... A63B 43/00

* cited by examiner

*Primary Examiner* — Eugene L Kim
(74) *Attorney, Agent, or Firm* — Ashley D. Johnson; Dogwood Patent and Trademark Law

(57) ABSTRACT

Through the use of an internal support system integrated with the interior shell of a hollow ball, the concentration of impact stress to the ball's shell during game play is reduced through better dispersion and resistance of applied force, while also reinforcing the ball's shell at its weakest points, which are the holes, thus making it more resilient and thereby less susceptible to breakage. Enhanced fortification against impact stress applied during gameplay serves to increase the usable life of the ball.

15 Claims, 8 Drawing Sheets

SECTION A

SECTION B

STRUCTURALLY REINFORCED PICKLEBALL

This application claims priority to provisional application 63/479,400, filed Jan. 11, 2023. The present invention relates generally to a hollow plastic ball, with holes in its spherical shell, used for game play and prone to breakage in the form of cracks and stress fractures. More particularly, the present invention relates to creating a ball with greater longevity by implementing structural changes to buttress against damage caused by repeated impact. This provides inherent monetary value to the consumer by extending the ball's functional life and reducing their environmental footprint through the elimination of excess plastic waste.

FIELD OF THE INVENTION

Background of the Invention

A hollow ball with holes made from plastic is used for game play of several sports. For example, one such sport is Pickleball. The ball used to play the sport of Pickleball is referred to as a pickleball. Per the USA PICKLEBALL Official Rulebook, Section 2.D. Ball Specifications; "Pickleballs have between 26 and 40 circular holes with spacing of the holes and overall design of the ball conforming to flight characteristics."

Pickleballs are typically manufactured by injection or rotational molding using various types of plastic. Per the USA PICKLEBALL Official Rulebook, Section 2.D.3. Construction; "The ball shall be made of a durable material molded with a smooth surface and free of texturing."

The ball is kept in play using a paddle to hit it over a net between opponents, thus the ball is subject to repeated impacts from both paddle strikes and the court surface while bouncing. The accumulation of impact stress fatigues the ball's plastic shell and, eventually unable to absorb additional energy, the overload causes the ball to crack. Once a ball cracks, the integrity of its action is compromised, and the ball is removed from play and permanently discarded.

Compounding the problem, plastic's response to impact stress is largely dependent upon two conditions, which are ambient temperature and age of the plastic itself. All plastic material has a ductile to brittle transition temperature, hereto referred to as DBTT. The DBTT is the point where plastic becomes brittle and shatters upon high-speed impact. At lower temperatures, some plastics that would be ductile at room temperature instead become brittle. This means when used for outdoor play, as the air temperature drops, the frequency of stress fractures and cracks in the pickleball's plastic shell significantly increase. Additionally, as plastic parts age their DBTT increases making them increasingly vulnerable to environmental stress factors when cracks can occur even at moderate temperatures.

BRIEF SUMMARY OF THE INVENTION

In an aspect described herein, disclosed is an interior structural support system integrated with the underside surface of a hollow ball's shell. The structural support system, generally in the form of a spherical lattice, may comprise a framework composed of struts, which may be connected, often in a geodesic topology, to adjacent hubs, which can encompass holes, herein also referred to as apertures, in the shell, all of which serve to reinforce the structural integrity of the ball and increase the ball's durability.

BRIEF DESCRIPTION OF THE FIGURES

FIG. 1-A would generally be considered a ball for outdoor play and FIG. 1-B would generally be considered a ball for indoor play.

DESCRIPTION OF THE INVENTION AND EXAMPLE EMBODIMENTS

The following is a detailed description of exemplary embodiments to illustrate the principles of the invention. The embodiments are provided to illustrate aspects of the invention, but the invention is not limited to any embodiment and the scope of the invention encompasses numerous alternatives and modifications. Numerous specific details are set forth in the following description in order to provide a thorough understanding of the invention. However, the invention may be practiced according to claims without some or all of these specific details. For the purpose of clarity, technical material that is known in the technical fields related to the invention has not been described in detail so that the invention is not unnecessarily obscured. It is readily apparent that the features described above have the advantage of wide commercial utility. It should be understood that the specific features described are intended to be representative only, as certain modifications within the scope of these teachings will be apparent to those skilled in the art. For example, the dimensions could be varied. Accordingly, reference should be made to the claims in determining the full scope of the invention. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
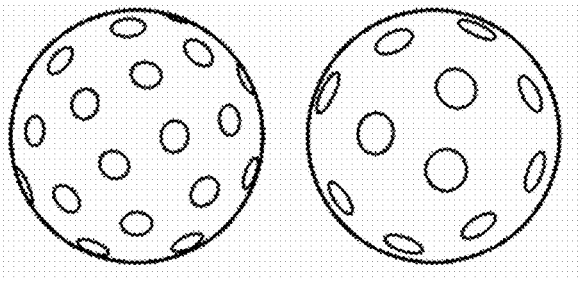
FIG. 1 illustrates example pickleball game balls with varying amounts of holes and hole sizes.

FIG. 1 shows two examples of pickleballs used for game play. Pickleballs used for game play conducted outdoors typically have a greater amount of holes that are smaller in size, as shown in FIG. 1-A, whereas game play conducted indoors typically use a pickleball with fewer holes that are larger in size, as shown in FIG. 1-B. Said holes, herein also referred to as apertures, determines the amount of airflow entering the ball, which affect corollary properties such as wind resistance, flight distance, and overall playability of a game ball. Holes should be shaped, dimensioned, and configured in a layout that allows sufficient airflow through the ball. Increased distance between adjacent holes can help reduce breakage.

Figure 2:
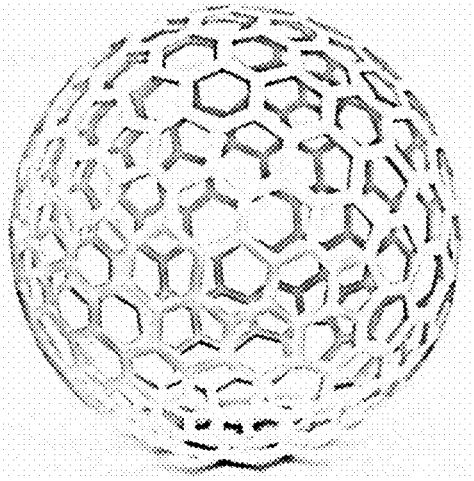
FIG. 2 displays a uniform geometric pattern of hexagons in a spherical lattice.

The first aspect of the general invention, as shown in FIG. 2, embodies a geometric pattern of symmetrical hexagons which form a sphere. With the understanding all shapes are composed of independent lines connected in such a way they create a form; said independent lines will herein be referred to as struts. Similar to a typical line, struts may exist in a linear, geometric, or freeform manner. Struts may intersect, connect, or terminate other struts. Struts may exist as independent segments and struts may have dimensionality. The embodiment illustrated in FIG. 2 suggests increasing a ball's shell strength through a structural lattice support framework, comprised of struts forming a uniform spherical hexagonal mesh, integrated on the interior surface of a hollow ball's shell.

Figure 3:
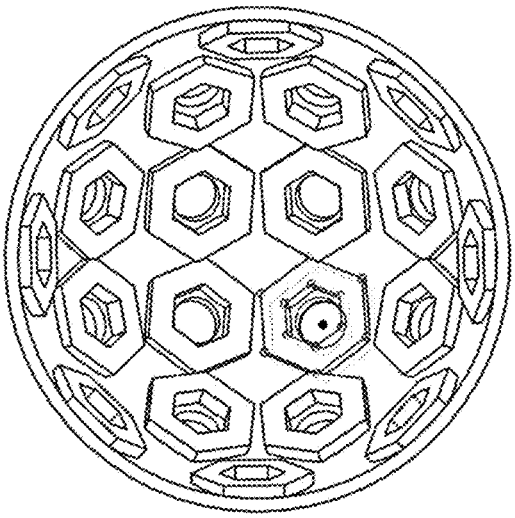
FIG. 3 is a view of hexagonal hubs surrounding each aperture in an asymmetric incongruous layout.

Another embodiment of the invention illustrated in FIG. 3 applies raised struts to the underside of the ball's shell which are connected in such a way they form hexagons. When struts connect to form the boundary of a shape that demands attention, said shape will herein be referred to as a hub. That is to say, the embodiment in FIG. 3 comprises hexagonal hubs which form a perimeter around each aperture. Though the hexagonal hubs are geometrically identical, they otherwise occupy an incongruous layout. Since the aperture, a perforation within the surface of the ball's shell, is its weakest point, this embodiment increases shell strength by fortifying the surface area around each aperture.

Figure 4:
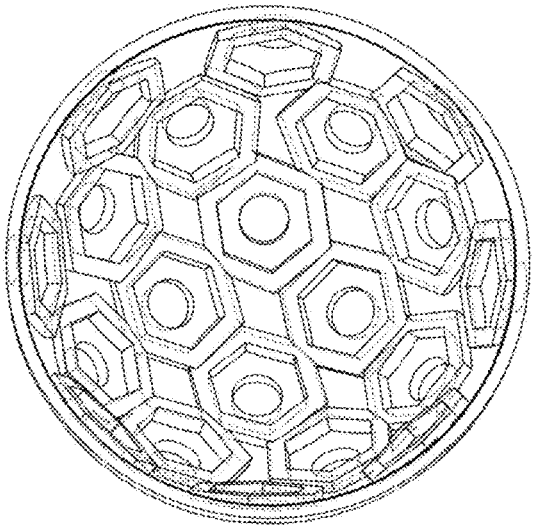
FIG. 4 is similar to FIG. 3, except that each hexagonal hub abuts an adjacent hexagonal hub or hubs.

A different embodiment of the invention, displayed in FIG. 4, applies raised struts in a manner that forms a grid of connected hexagonal hubs. Each hub is situated around an aperture and shares a portion of an adjoining wall with adjacent hubs. In this embodiment, each hexagonal hub has a border wall that is set back further from the aperture precipice than the embodiment shown previously in FIG. 3.

It is to be understood that any combination of struts and/or hubs integrated with the spherical shell of a ball is herein referred to as a lattice support framework. A lattice support framework comprised of struts and/or hubs, may be polygonal, circular, or any freeform shape that is preferred. All dimensional properties of said framework are variable in terms of layout, design, density, and geometry to best accommodate the desired application. Apertures may be encompassed by hubs and/or struts. The quantity, location, size, and placement configuration of apertures within the ball's shell may require the implementation of a lattice support framework that is neither contiguous nor congruent in form.

Figure 5:
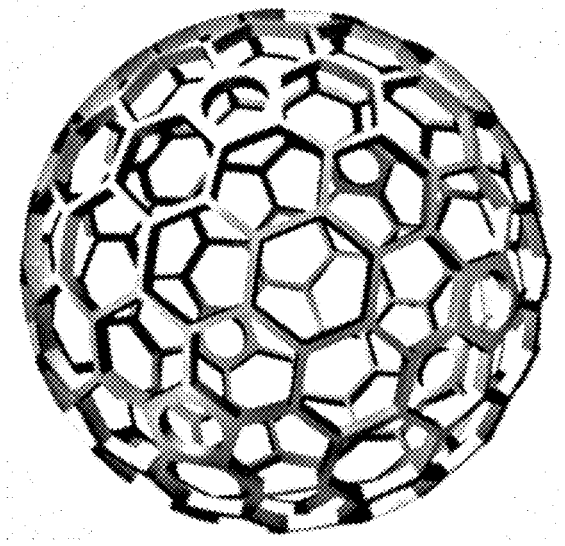
FIG. 5 displays a spherical lattice formed of adjoining pentagonal and hexagonal shapes.

FIG. 5 shows an embodiment of a reinforcement method using a spherical lattice support framework comprised in a geodesic layout. Each raised strut spans from an intersectional nodal point to create an interconnected grid of pentagonal and hexagonal hubs that is greater in density and more dimensionally complex than previous embodiments. This embodiment discerns the difference between pentagonal structural hubs that encapsulate apertures and hexagonal hubs devoid of an aperture in its perimeter.

Figure 6:
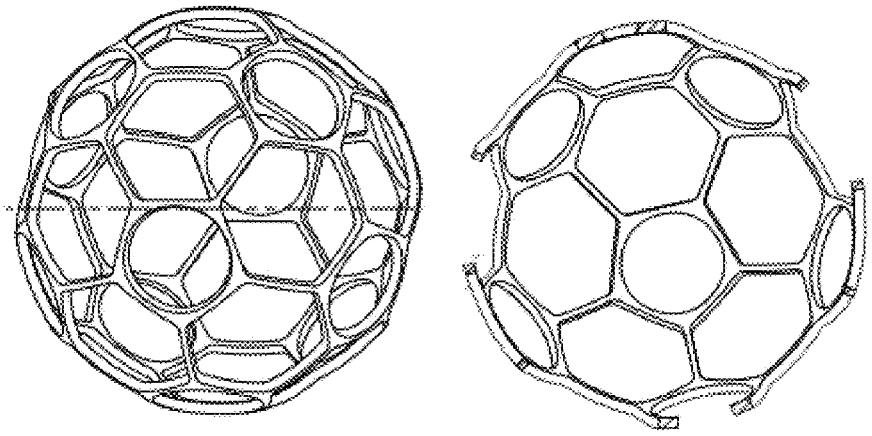
FIG. 6 presents pentagonal and hexagonal forms joined together in a spherical lattice, centered around each aperture, with two hemispheres combined in FIG. 6-A, and a single hemisphere in FIG. 6-B.
Figure 7:
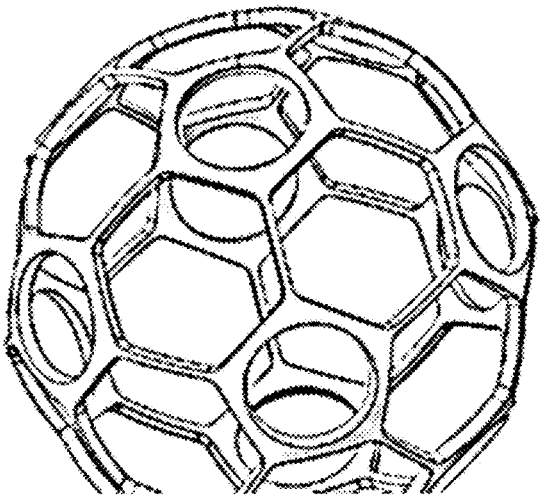
FIG. 7 is similar to FIG. 6, but shows an increase of wall thickness on each pentagonal hub.

Another embodiment of the invention in FIG. 6 comprises a layout of lattice support framework where struts span outward from the corner of each hub and form adjacent hub walls, which interconnect one to another. The polygonal lattice support framework is less dense, where pentagonal and hexagonal hubs allow a generous perimeter around each intended aperture location in the ball's exterior shell. FIG. 6-A illustrates two hemispheres combined whereas FIG. 6-B displays a single hemisphere, The embodiment of the invention in FIG. 7 illustrates the application of increased wall thickness in pentagonal hubs and a decrease in the strut thickness forming hexagonal hubs.

Figure 8:
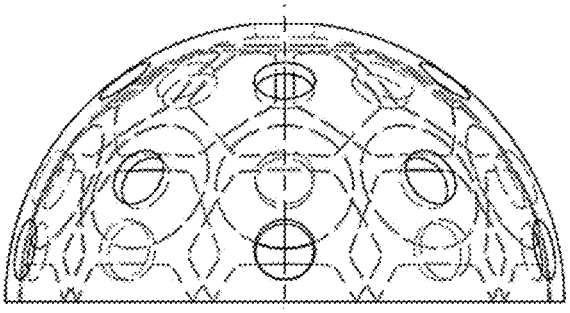
FIG. 8-A illustrates the top hemisphere of a ball's exterior shell with a view of inlaid support framework imposed underneath, while FIG. 8-B is an interior view of the hub and strut support model integrated on the underside of the ball's shell where a lattice of pentagonal and hexagonal hubs frame the apertures.
Figure 8:
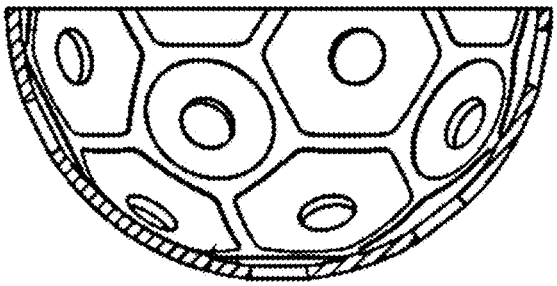

In the embodiment of FIG. 8-A, a view of the exterior ball's top hemisphere which comprises a hub and strut lattice support framework imposed underneath. FIG. 8-B displays an interior view of the ball's bottom hemisphere, where a raised lattice support framework is integrated on the underside surface of the shell with alternating pentagonal and hexagonal hubs surrounding the apertures.

Figure 9:
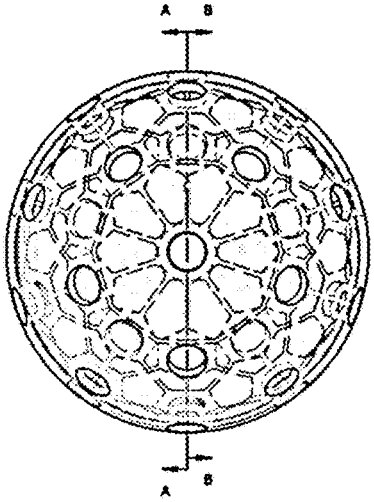
FIG. 9-A is an example embodiment of a hollow game ball with both hemispheres combined along an equatorial line and its apertures displayed in relation to an underlying support framework, while FIG. 9-B shows a single hemisphere of FIG. 9-A when viewed from the shell's underside.
Figure 9:
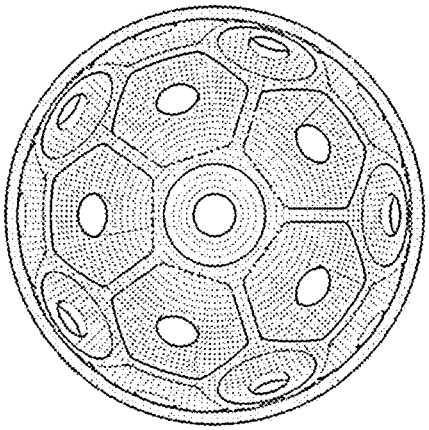
Figure 10:
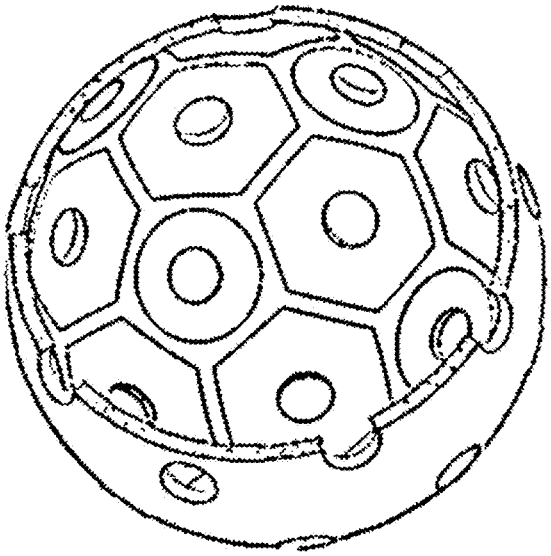
FIG. 10 displays two interior wall variations for pentagonal hubs outlining an aperture perimeter, where FIG. 10-A is comprised of curved walls and FIG. 10-B is comprised of straight walls.
Figure 10:
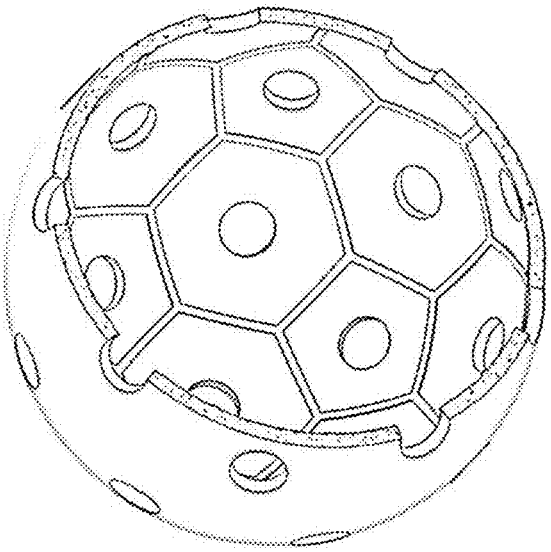

FIG. 9-A embodies an example game ball with hemisphere A and hemisphere B combined along an equatorial line, and its apertures in relation to the underlying lattice support framework. FIG. 10-B displays a reverse view of the hemisphere's lattice support framework with a pentagonal hub oriented at the top of the game ball's spherical shell.

FIG. 10 comprises exemplary embodiments of the present invention in relation to potential geometric variations in the composition of hub walls. FIG. 10-A illustrates pentagonal hubs where a circular wall is utilized for the aperture perimeter while FIG. 10-B illustrates pentagonal hubs utilizing an angular wall for the aperture perimeter.

Figure 11:
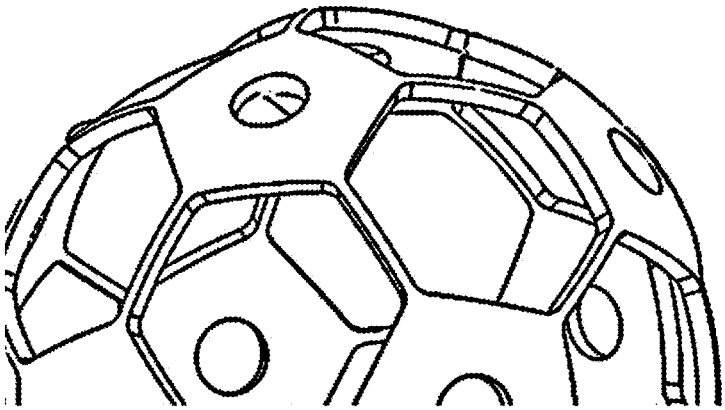
FIG. 11 shows a structural lattice support framework of struts connecting pentagonal hubs that are infilled to the edge precipice of alternating apertures in the ball's shell.

In FIG. 11, another embodiment of the present invention illustrates a lattice support framework comprised of raised struts connecting equally spaced solid frame pentagonal hubs encompassing each aperture. By infilling the encapsulated area up to the edge precipice of the aperture, this embodiment draws upon a fundamental engineering concept of increasing material thickness increases material strength.

Figure 12:
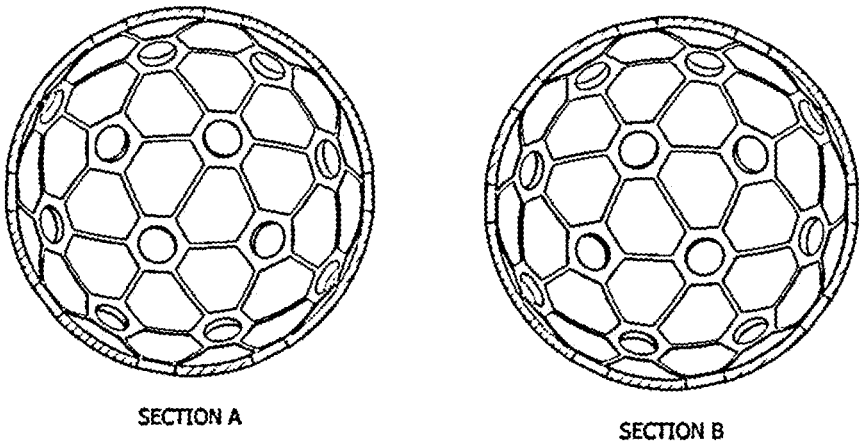
FIG. 12 shows an example game ball outfitted with a reinforcing lattice support framework on the interior of a hollow shell that is spherical in shape and comprises a first hemisphere, SECTION A, and a second hemisphere, SECTION B, that interface along an equatorial line.

The exemplary embodiment of the present invention in FIG. 12 shows a game ball that comprises a hollow shell that is spherical in shape and comprises a first hemisphere, SECTION A, and a second hemisphere, SECTION B, which interface along an equatorial line. Similar to FIG. 11, the structural lattice support framework comprises a network of interconnected struts and hubs, where only infilled geometric hubs are outfitted with apertures.

Figure 13:
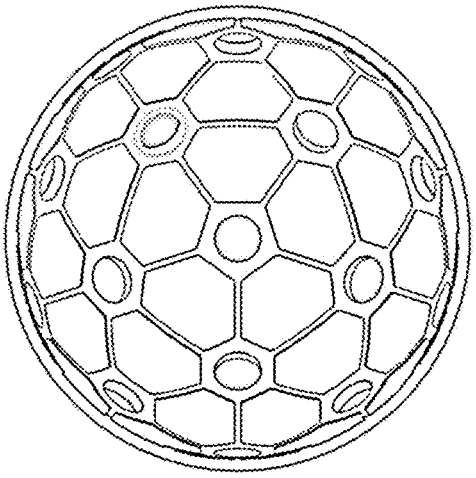
FIG. 13-A illustrates an interior lattice support framework comprised of pentagonal hubs framing each aperture in contrast to FIG. 13-B where circular hubs frames each aperture.
Figure 13:
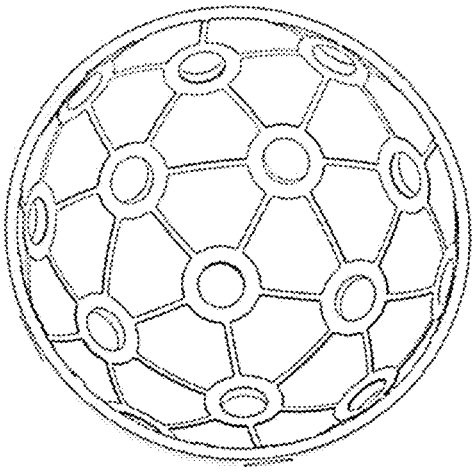

FIG. 13 illustrates exemplary embodiments of lattice support framework which can be comprised of any combination of integrated shapes or patterns, whether geometric or freeform, provided they are contained solely to the interior of the ball as to not protrude past the exterior shell or interrupt the smooth surface of the ball. FIG. 13-A comprises an interior lattice support framework with an array of polygonal shaped hubs that encompass each aperture, whereas FIG. 13-B comprises an interior lattice support framework of circular shaped hubs that encompass each aperture.

Figure 14:
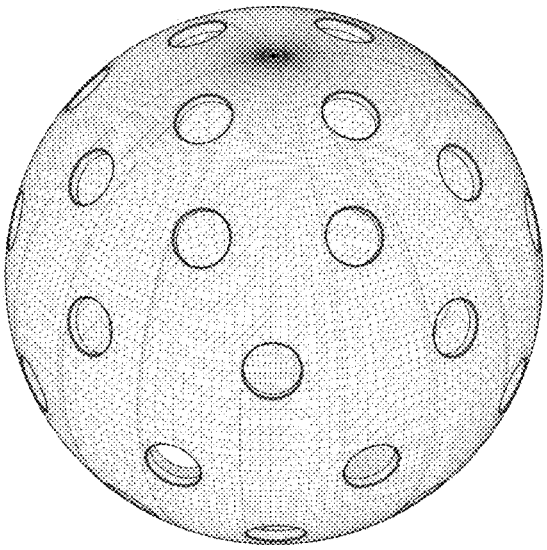
FIG. 14-A and FIG. 14-B are example embodiments of a typical pickleball with shell apertures that possess a 90-degree angle.
Figure 14:
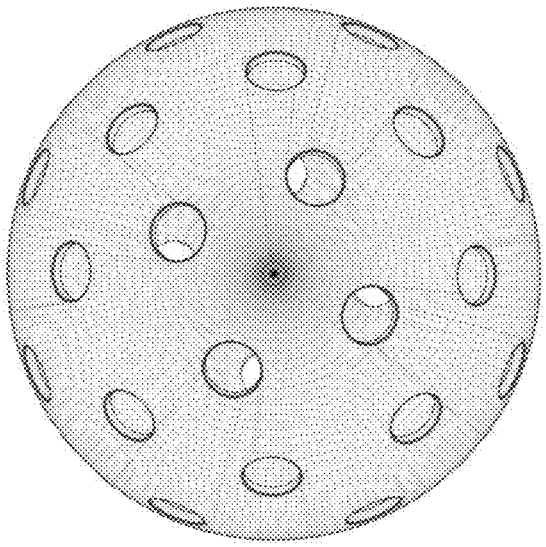

The embodiments in FIG. 14-A and FIG. 14-B are typical pickleball game balls comprised of apertures possessing an edge profile that forms a 90-degree right-angle where said apertures perforate the ball's shell. The rigidity of a sharp 90-degree angle lends itself to a greater concentration of energy absorption over a smaller area, thus greater shell deformation occurs when the ball impacts exterior objects. This, in turn, accelerates degradation of shell strength and reduces the ball's ability to withstand subsequent stress applied.

Figure 15:
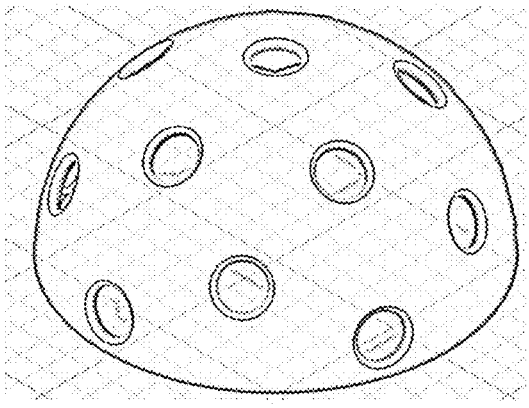
FIGS. 15-A and 15-B are example embodiments of apertures where a concave edge and a radius curve slope inward toward the center of the ball.
Figure 15:
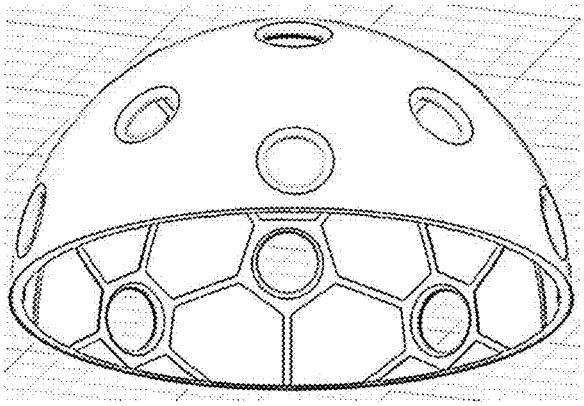

The embodiments in FIG. 15-A and FIG. 15-B comprise a modified exterior aperture edge, by altering said edge profile from a typical 90-degree angle to an edge profile comprised of a contoured arc that funnels inward. Eliminating the typical hard right-angle edge and replacing it with a radius concave edge, preferably with a gradient curvature greater than 91-degrees, results in better deflection and dispersion of concentrated impact stress, thereby reducing a significant contributing factor to ball breakage.

Figure 16:
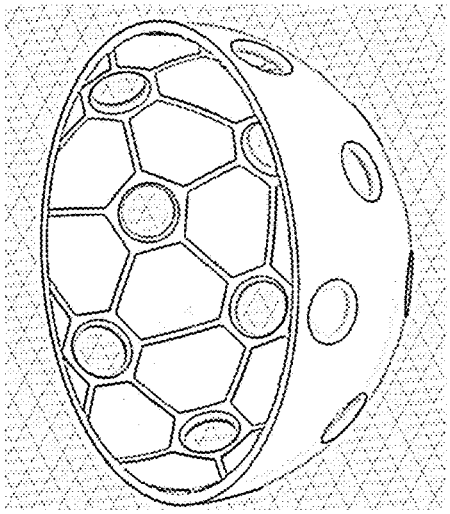
FIG. 16-A is similar to FIG. 15-B but shown from another perspective while FIG. 16-B illustrates a close-up perspective of the aperture edge profile comprising a contoured arc that funnels inward.
Figure 16:
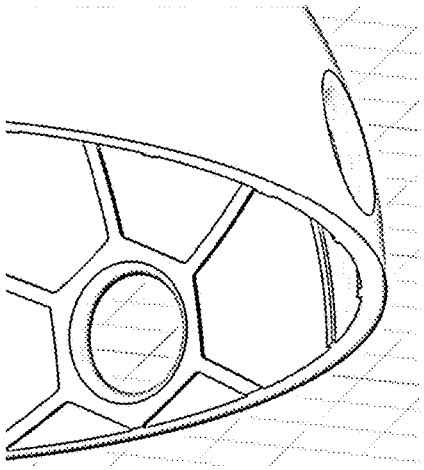

In example embodiments of FIG. 16-A and FIG. 16-B, the full circumference of each aperture comprises a concave radius edge with an arcing sidewall that slopes inward toward the center of the ball.

Figure 17:
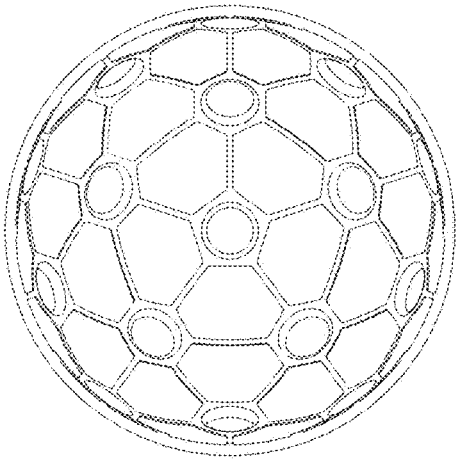
FIG. 17-A embodies the top hemisphere of a game ball with integrated lattice support framework and a modification applied to the aperture profile, while FIG. 17-B embodies the bottom hemisphere of said ball in FIG. 17-A.
Figure 17:
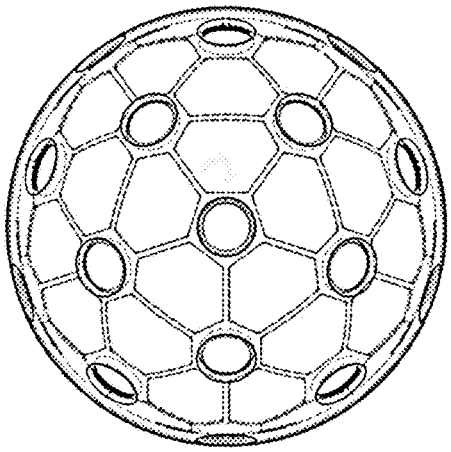

The exemplary embodiment in FIG. 17-A comprises a single hemisphere of a game ball, as observed from below, with fully integrated lattice support framework and radius concave holes. In FIG. 17-B, the same embodiment as FIG. 17-A is viewed from above with an overlay of its lattice support framework and radius concave holes. The thickness of the ball's exterior shell and the thickness of the interior structural lattice support framework are independent and thereby not linked to a predefined ratio. Their variable thicknesses are only mutually exclusive in that their values are measured in totality to calculate the total weight of the ball.

Figure 18:
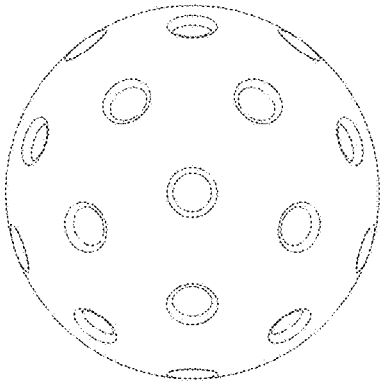
FIG. 18-A, FIG. 18-B, and FIG. 18-C are exemplary embodiments of the present invention that depict a pickleball game ball in its entirety, as would be visible to the naked eye.
Figure 18:
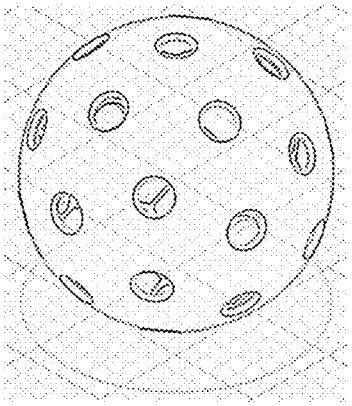
Figure 18:
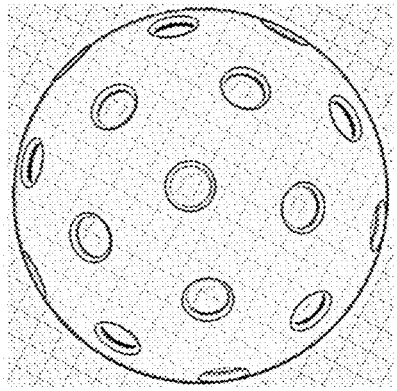

For dimensional illustration, FIG. 18-A, FIG. 18-B, and FIG. 18-C illustrate pickleball game balls according to an exemplary embodiment of the present invention. Preferably, the hollow shell is the same size as a regulation game ball used in accordance with an officially sanctioned pickleball game. Alternatively, the hollow shell is formable with any dimension and can be made of a suitable material such as plastic or a polymer such as, for example, resin and polyethylene. The hollow shell may be manufactured as one sphere or two semi-spheres that are joined together at their equatorial line. Preferably, the ball is made of a plastic material that is recyclable to further reduce the impact on our environment.

The disclosed embodiments are illustrative, not restrictive. While specific configurations of the design have been described, it is understood that the present invention can be applied to a wide variety of balls as there are many alternative ways of implementing said invention.

What is claimed is:

1. A ball for playing a game, the ball comprising:
- a shell that is uniformly spherical with an outside surface and inside surface;
- a hollow interior space defined by the inside surface of the shell;
- a plurality of apertures that perforate the shell;
- wherein the shell structurally integrates a lattice support framework comprising:
  - a geometric hub, a freeform hub, or a multitude of geometric hubs, and a multitude of freeform hubs on the interior surface of the shell that encompass the plurality of apertures;
  - a topology of struts on the interior surface of the shell that interconnect, intersect, or both interconnect and intersect adjacent geometric hubs, freeform hubs, or both geometric and freeform hubs;
  - a topology of the struts, the geometric hubs, the freeform hubs, or both that connect, intersect, or both connect and intersect to form a novel geometric hub, a novel freeform hub, a novel strut, a multitude of novel geometric hubs, a multitude of novel freeform hubs, a multitude of novel struts, or combinations thereof on the interior surface of the shell; and
  - the topology of struts configured as segmented struts, segmented geometric hubs, segmented freeform hubs, or combinations thereof that are disconnected from other segmented struts, geometric hubs, freeform hubs, or combinations thereof.

2. The ball as in claim 1, wherein, perforating the shell through a gradient curve, said apertures comprise:
- a contoured arc applied to the edge of the interior and/or exterior circumference of an aperture or multiple apertures;
- a radius profile sidewall edge, angled greater than 90 degrees, sloping concavely or convexly from the outer shell toward the center of the ball, applied to the circumference of an aperture or multiple apertures.

3. The ball of claim 1, wherein the shell comprises the lattice framework structurally integrated into the shell and bounding a hollow interior space, where the lattice support framework faces the hollow interior space; and
- wherein the geometric hubs, freeform hubs, or both project into the hollow interior space from the shell; and the plurality of apertures perforate the shell at the geometric hubs, freeform hubs, or both the geometric hubs and freeform hubs.

4. The ball of claim 3 wherein the geometric hubs, freeform hubs, or both project into the hollow interior space from the shell and wherein the plurality of apertures perforate the shell at the geometric hubs, freeform hubs, or both.

5. The ball of claim 3, further comprising the topology of struts that interconnect and/or intersect the geometric hubs, freeform hubs, or both to form a topology of networked struts.

6. The ball of claim 1, wherein a topology of networked struts include individual struts extending between and interlinking respective pairs of neighboring geometric hubs, freeform hubs, both geometric hubs and freeform hubs, neighboring struts, or combinations thereof.

7. The ball of claim 1, wherein the shell comprises two hemispherical halves that each include a hemispherical edge, wherein each of the two hemispherical halves are combined together at each respective hemispherical edge to form a hollow spherical shell, where the lattice support framework for each hemispherical half joins at the respective hemispherical edges.

8. The ball of claim 1, wherein each geometric hub, freeform hub, or both defines a uniform geometric shape.

9. The ball of claim 1, wherein the apertures have a radius profile greater than 91 degrees creating an arcing contoured curvature where the edge of each aperture angles inward from an outer surface of the shell toward a center of the shell.

10. The ball of claim 9, wherein the plurality of apertures each have a circumference at the outer surface of the shell.

11. The ball of claim 9, wherein the arcing contoured curvature is a concave curvature.

12. The ball of claim 1, wherein the ball is a pickleball ball.

13. The ball of claim 1, wherein the topology of struts form a uniform spherical hexagonal mesh integrated on the shell interior surface.

14. The ball of claim 13, wherein a unform geometric shape is a hexagon.

15. The ball of claim 14, wherein each aperture is centered within a symmetrical hexagon.

* * * * *